US006672690B1

(12) United States Patent
Williams

(10) Patent No.: US 6,672,690 B1
(45) Date of Patent: Jan. 6, 2004

(54) METHOD OF CONSTRUCTING AND ASSEMBLING CUPBOARDS AND WARDROBES

(75) Inventor: Laurence Graham Williams, Leigh on Sea (GB)

(73) Assignee: Workshop for Housing Limited, Essex (GB)

( * ) Notice: Subject to any disclaimer, the term of this patent is extended or adjusted under 35 U.S.C. 154(b) by 0 days.

(21) Appl. No.: 10/018,513

(22) PCT Filed: May 3, 2002

(86) PCT No.: PCT/GB00/01694

§ 371 (c)(1),
(2), (4) Date: May 3, 2000

(87) PCT Pub. No.: WO00/67612

PCT Pub. Date: Nov. 16, 2000

(30) Foreign Application Priority Data

May 5, 1999 (GB) ..... 9910381

(51) Int. Cl.[7] ..... A42F 5/08
(52) U.S. Cl. ..... 312/245; 312/257.1
(58) Field of Search ..... 312/245, 246, 312/247, 257.1, 263, 351; 108/106, 107, 108, 193; 160/135, 351; 52/126.1, 126.3, 126.4, 243.1, 238.1, 239; 211/85.3, 90.01, 90.04, 103, 119.003, 187

(56) References Cited

U.S. PATENT DOCUMENTS 3,159,437 A * 12/1964 Jentzen ..... 312/108
3,172,166 A * 3/1965 Imbrecht ..... 52/2.11
3,602,159 A 8/1971 Marschak
3,698,329 A * 10/1972 Diamond et al. ..... 108/42
3,870,157 A * 3/1975 Hayward ..... 211/90.01
4,324,076 A * 4/1982 Honickman ..... 52/27
4,938,442 A * 7/1990 Mastrodicasa ..... 248/250
5,212,918 A * 5/1993 Newhouse et al. ..... 52/126.3
5,230,492 A * 7/1993 Zwart et al. ..... 248/220.42
5,297,486 A * 3/1994 Herrmann et al. ..... 108/108
5,439,123 A 8/1995 Nook
5,477,971 A * 12/1995 Howard ..... 211/187
5,524,394 A * 6/1996 Szabo et al. ..... 52/36.1

FOREIGN PATENT DOCUMENTS

DE 1926832 12/1970
DE 2260650 6/1974

* cited by examiner

*Primary Examiner*—Janet M. Wilkens
(74) *Attorney, Agent, or Firm*—Smith-Hill and Bedell

(57) ABSTRACT

A method of constructing a wardrobe or cupboard is disclosed which comprises securing to a wall two vertical tracks each having an apertured surface. Two side panels each having projections at its rear edge that engage in the apertures in the tracks are then mounted on the tracks to secure the side panels to the wall without the tracks supporting the weight of the side panels. Subsequently, horizontal elements of the wardrobe or cupboard are secured to the side panels.

11 Claims, 2 Drawing Sheets

METHOD OF CONSTRUCTING AND ASSEMBLING CUPBOARDS AND WARDROBES

FIELD OF THE INVENTION

The present invention relates to a method of constructing a cupboard or a wardrobe.

BACKGROUND OF THE INVENTION.

The conventional manner of constructing a cupboard or a wardrobe is to assemble a carcass by securing two vertical side panels to at least two horizontal elements such as the base, the top or a shelf. Once a self-supporting carcass has been assembled, is it is secured to a wall while taking care to maintain the sides vertical. If the sides are not correctly secured to the wall, then it will be difficult to mount the doors on the carcass in such a manner as to be level with one another and with the carcass.

Because of these considerations, it has hitherto required skilled labour in order to assemble and erect wardrobes and cupboards. The need to employ skilled labour, in particular in situations such as new homes where they are required to fit flush from floor to ceiling, has added considerably to their cost.

GB-A-965,052 and U.S. Pat. No. 3,950,051 disclose methods of furniture assembly which involve mounting on a wail two vertical tracks having a series of keyhole apertures, mounting on the tracks shelf brackets having rear projections that engage in the keyhole apertures and building a cupboard by securing horizontal and vertical panels to the shelf brackets. In such a construction, the weight of the cupboard is cantilever supported on;the vertical brackets. In modern methods of constructing homes, where the interior walls are made of stud-work, the sheets of plasterboard would not have sufficient strength to support the weight of a cupboard in this manner.

OBJECT OF THE INVENTION

The present invention seeks to provide a method of constructing and assembling a wardrobe or cupboard that mitigates the foregoing problems and avoids the need for costly skilled labour.

SUMMARY OF THE INVENTION

In accordance with the present invention, there is provided a method of constructing a wardrobe or cupboard which comprises securing to a wall two vertical tracks each having an apertured surface, mounting on the tracks two side panels each having projections at its rear edge that engage in the apertures in the tracks and subsequently securing horizontal elements of the wardrobe or cupboard to the side panels, wherein the engagement of the rear projections of the side panels in the vertical tracks serves to prevent lateral movement of the rear edges of the side panels relative to the wall and to prevent the side panels from separating from the wall but not to support the weight of the side panels.

The tracks secured to the wall may be generally similar to tracks used for adjustable shelving. The apertures in such tracks are keyhole shaped. Alternatively, as the tracks do not support the weight of the side panels, the tracks may comprise an extrusion defining a channel, the extrusion being machined at intervals to provide entry points into the channel for the projections on the side panels.

The projections may suitably be screws that are driven into the rear edge of each side panel, the heads of the screws being held captive in the channel of the extrusion when not aligned with an entry point.

The tracks are preferably of the same width as the side panels and located between the rear edges of the side panels and the wall. Such tracks can readily be disguised by covering them with a veneer matching the surface finish of the side panels, leaving no obvious visible means of fixing of the side panels to the wall.

It does not require great skill to mount a first track on a wall so that it lie vertically. If the track is screwed at its upper end to the wall, then one can position a plumb line in the channel near the upper end of the track and adjust the attitude of the track until the plumb line lies exactly central in the channel over its entire height. The position of the track of the remaining fixing 'screws can then be marked accurately.

To locate the second track vertically and at the correct distance from the first track, it is only required to position one of the horizontal elements of the wardrobe against the first track and to mark the position of the opposite parallel edge of the horizontal element. This will ensure that the second track is also vertical and at the correct distance from the first track.

Each shelf, in the case of a wardrobe, may conveniently have a hanging rail pre-mounted thereon and it may have a front down stand to reduce the tendency of the shelf to bow and to increase the rigidity of the wardrobe by bracing the side panels.

While it is possible to secure a base element and a plinth to the side panels after they have been mounted on the wall, it is preferred to provide a pre-assembled free standing base, to position the base against the wall and subsequently to secure the tracks to the wall in alignment with the base.

In this case, the base may be provided with holes to engage dowels projecting from the lower edges of the side panels so that the side panels may be held in place on the base by their own weight alone.

The side panels may conveniently be provided with shelf support brackets on their inner sides, each bracket having keyhole apertures to receive the heads of screws projecting from the underside of the shelf. The screw heads are preferably tapered on their underside and dimensioned to engage the support bracket by friction once the shelf has been mounted on its support bracket.

When a wardrobe is to fit from floor to ceiling, it is desirable to avoid any gap between the top of the wardrobe and the ceiling. As there will always be variations in the height of rooms this normally requires to a skilled workman to cut a fillet that bridges the gap neatly. To mitigate this problem, the method may further comprise the step of mounting resiliently expandable fillets to bridge any gap between the upper edges of the side panels and the room ceiling and/or the side panels and an adjacent wall.

After the fillets have been mounted on the side panels in contact with the ceiling, it is possible to secure to them an embellishment board to impart a neat fitted appearance to the front of the wardrobe.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
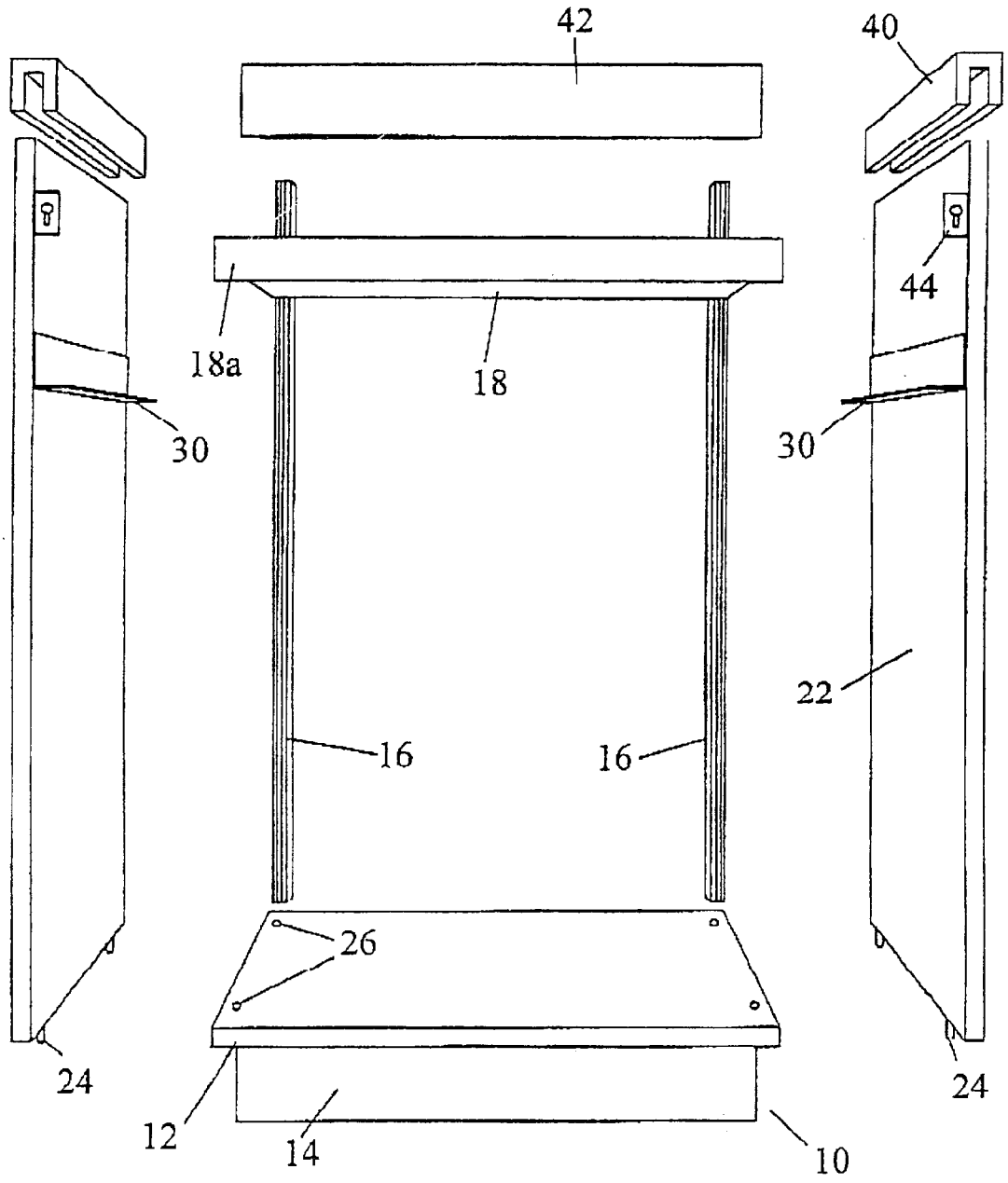
FIG. 1 shows an exploded view of a wardrobe to demonstrat its method of construction and assembly.

FIG. 1 shows the parts of a flat pack wardrobe that are relevant to the present invention. As will be clear from the following description, the flat pack also contains components other than those illustrated.

The wardrobe is formed of a pre-assembled base 10 that has a horizontal element 12 and a kick board or plinth 14. The first step in the erection of the wardrobe after it has been unpacked is to place the base 10 against the wall on which the wardrobe is to be mounted.

Next two tracks 16 are screwed to the wall in line with the outer edges of the base 10. To assist in alignment, it is possible to form the rear edge of the horizontal element 12 with two cut-outs (not shown) for receiving the lower ends of the tracks 16. With the first track located in the cut-out in the base 10, the upper end of the track is moved from side to side until it is plumb vertical. This can be ascertained by means of a device that plugs into the track 16 and has a weight hanging from a string. When the string lies exactly parallel to the sides of the track, marks are made on the wall for the screws that are to fix the track to the wall.

An appropriate fixing is now used to screw the first track to the wall. The type of fixing used will of course depend on the nature of the wall. In particular, a hollow stud-work wall (plasterboard wall) will require special screws otherwise proprietary plugs may be used to secure the tracks to a rendered brick or concrete wall.

After the first track has been secured to the wall, a shelf panel 18 placed flat against the wall with one edge in contact with the track is used to position the other track at the correct distance from the first track. Of course, as the shelf 18 is pre-cut with parallel sides, the second track will automatically be aligned in parallel with the first.

Figure 2:
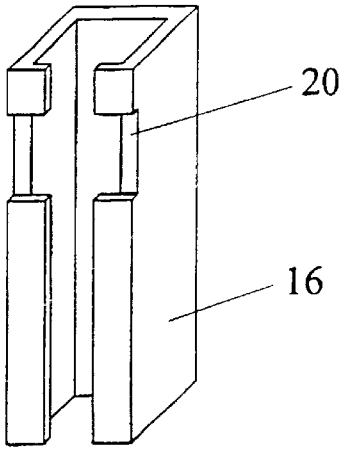
FIG. 2 is a perspective view of a section of the track used to secure the rear edges of the side panels to the wall.

The tracks 16, as shown in a FIG. 2, comprise an aluminium extrusion of U-shaped section designed to receive the heads of screws projecting from the rear edges of the side panels. At intervals, the U-shaped channel is machined as shown to provide an entry point 20 for the screw heads. It would be alternatively possible to provide individual apertures for the screws by using tracks similar to those conventionally used for shelving and racks, but this would make for a more expensive construction.

The side panels are mounted on the wall by introducing the heads of screws projecting from their rear edges into the various entry points 20 and then allowing the side panels to drop under their own weight to engage dowels 24 projecting their lower edges into holes 26 provided near the edges of the base element 12. By gravity alone, the side panels 22 are now secured to the base 10 and this prevents the base from moving away from the wall.

It is important that the weight of the side panels should be taken up by the base and not by the tracks as the latter may not have sufficient strength to support the weight of the wardrobe. Hence, if individual keyhole apertures are formed in the tracks, it should be ensured that they are dimensioned and positioned in such a manner that the projecting screw heads do not reach to lower edges of the apertures. The fact that the screw heads do not reach the lower edges of the apertures also provided considerably latitude in the vertical positioning of the tracks.

The tracks 16 are screwed tightly against the wall and if the wall is slightly convex of concave, this will result in the tracks adopting the same shape. This need not however interfere with the mounting of the side panels as the locating screws can be screwed in or out take up the irregularity.

Figure 3:
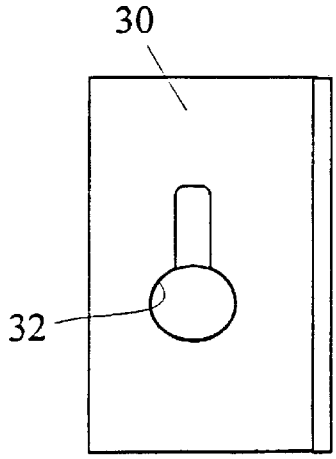
FIG. 3 is a partial plan view of one of the shelf support brackets secured to the inner surface of the side panels.
Figure 4:
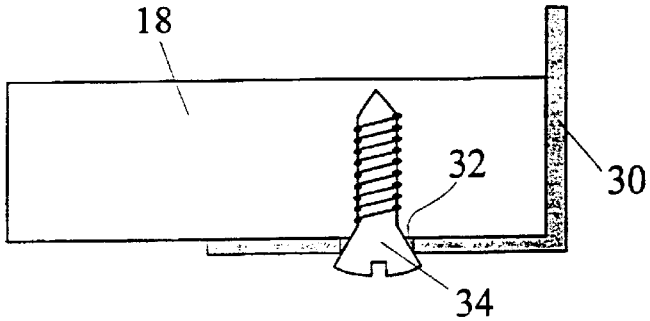
FIG. 4 is a section through a shelf mounted on one of the support bracket.

The side panels 22 have L-shaped shelf support brackets 30 secured to their inner surfaces. On their horizontal surfaces, shown in plan view in FIG. 3, the brackets 30 are formed with keyhole apertures 32. Each shelf 18 has projecting from its under surface screws 34 that engage in the keyhole apertures 32. The screws preferably have tapered heads to grip the edges of the aperture 32 and to prevent the shelf from sliding once it has been firmly pushed into place against the back wall of the wardrobe. The shelf can if desired have a hanging rail accured to it underside and is preferably provided along its front edge with a down stand 18*a*, as illustrated. The down stand 18*a* strengthens the shelf to allow it to support more weight without bowing and also improves the rigidity of the entire carcass. If it is desired to construct a cupboard instead of a wardrobe, then it is of course possible to provide more shelves.

The side panels 22 are of the same width as the track 16 so that the tracks will form a continuation of the side panels. If it is desired to disguise the tracks, or to cover any gap created by irregularity in the wall, then a veneer may be applied to the side surfaces of the tracks on the outside and/or inside surface of the wardrobe, to match the side panel.

It is preferred to form the tracks and the shelf of a metal, such as aluminium, that is softer metal than the metal of the screw heads. In this way, the tapered screw heads will bite and deform the metal to provide a firm location that will not be easily dislodged.

In order to fill the gap between the upper edges of the side panels and the ceiling, fillets 40 are provided in the form of inverted U-shaped channels. A foam (not shown) may be used to fill the U-shaped channel, at least in part, and the exposed surface of the foam may be covered with a strip of flexible plastics material such as an acetate. The slippery acetate strip allows the fillet 40 to be slid into the gap between the upper edge of the side panels 22 and the ceiling, the compressed foam acting as a spring to force the fillet 40 against the ceiling. The length of the limbs of the U-shaped channel of the fillet 40 determines the tolerance in ceiling height that the wardrobe can accommodate.

The front ends of the fillets 40 are conveniently mitred and provided with spring clips by means of which a front fillet can be secured to them to enhance the frontal appearance of a wardrobe.

It is further desirable to attach a cross piece 42 across the upper ends of the side panels. Such a cross piece 42 can once again be assembled rapidly by means of brackets 44 having keyhole apertures into which screws projecting from the cross piece can be dropped.

Figure 5:
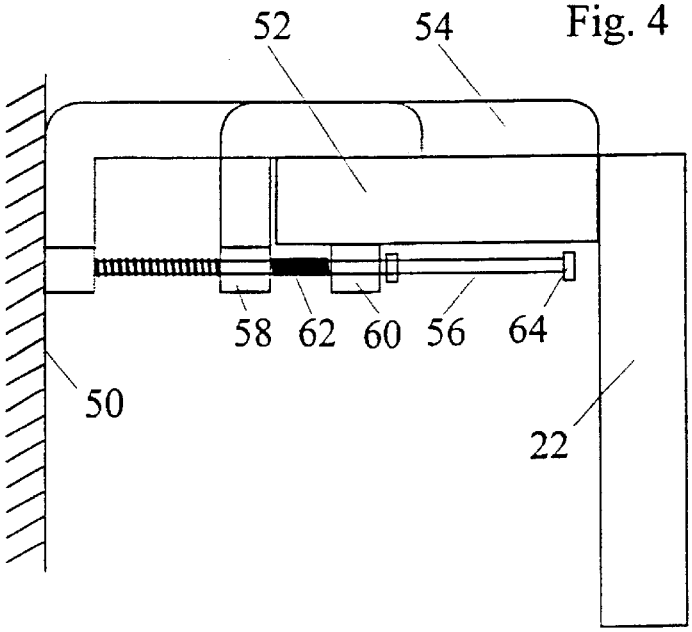
FIG. 5 shows a section through an expandable fillet to cover a gap between a side panel of the wardrobe and an adjacent alcove wall, the fillet being shown in its compressed state in solid lines and in its extended state in dotted lines.

If a wardrobe is to be fitted into an existing alcove or recess, then a neater appearance is achieved by using an expanding fillet as shown in FIG. 5 to fill any gap between the side panel 22 and the wall 50 of the recess. The expanding fillet comprises two overlapping boards 52 and 54 that are connected to one another by rods 56 and support blocks 58, 60 on the rear sides of the boards 52 and 54. Each rod 56 is secured to the support block 58 and is slidable in the other block 60. Springs 62 surrounding the rods 56 bias the blocks 58 and 60 apart. End stops on the rods 56 prevent the components of the expanding fillet from separating before installation.

To install the fillet, the springs 62 are compressed and the fillet is simply pushed into place while in its state shown in solid lines. The fillet is then released to expand into the position shown in dotted lines. A permanent fixing is achieved by securing edge of the board 52 to the side panel 22 of the wardrobe by a suitable adhesive.

The described construction of the wardrobe ensures that the sides of the wardrobe or cupboard are plumb vertical and that its base and shelves are horizontal. Consequently when doors (not shown) are mounted on the front edges of the side panels 22, the doors will also be vertical and their upper and lower edges level with one another, without the need for adjustment.

It is preferred to provide the doors with separable hinges, as are currently available on the market. One part of each hinge can be pre-mounted on the side panel and the other on the door, requiring only for the two parts to be clipped into one another to provide a permanent mounting.

It will be noted that in the preferred construction, tools are only required to mount the tracks on the wall. From that point onwards all of the components of the wardrobe can be assembled without the use of tools and the rigidity of the wardrobe is assured by its own weight.

In the case of new homes, it would be possible for the tracks to be formed as part of the wall and level with the plastered surface of the wall. However, such a construction makes it difficult to make changes to room design and is not preferred.

It will be appreciated many modifications may be made to the described method of construction without departing from the scope of the invention as defined in the appended claims. In particular, the base could be replaced by a shelf and the kick panel 14 could be secured in the same manner as the cross piece using angled brackets with keyhole apertures. Furthmore, the invention need not necessarily be applied only to a floor to ceiling wardrobe and may equally be applied to a wall mounted cupboard or a base unit.

Instead of a seperate fillet being provided to fit over each side panel, it would be alternatively possible to provide a top that is in one piece to slide over both the side panels, resilient member still being used to push it flush against the ceiling. While foam is a convenient means of resiliently urging the fillets or the top upwards, it would of course be possible to use leaf springs.

What is claimed is:

1. A method of constructing a wardrobe or cupboard which comprises securing to a wall two vertical tracks each having an apertured surface, mounting on the tracks two side panels each having projections at its rear edge that engage in the apertures in the tracks and subsequently securing horizontal elements of the wardrobe or cupboard to the side panels, wherein the engagement of the rear projections of the side panels in the vertical tracks serves to prevent lateral movement of the rear edges of the side panels relative to the wall and to prevent the side panels from separating from the wall but not to support the weight of the side panels.

2. A method as claimed in claim 1, which comprises forming the tracks of the same width as the side panels.

3. A method as claimed in claim 2, wherein a veneer matching the surface finish of the side panels is applied to at least one side surface of the tracks.

4. A method as claimed in claim 1, wherein at least one of the horizontal elements secured to the side panels comprises a shelf.

5. A method as claimed in claim 1, wherein at least one of the horizontal elements secured to the side panels comprises a shelf having a front down stand pre-mounted thereon.

6. A method as claimed in claim 1, which comprises positioning a free standing base against the wall, securing the tracks to the wall in alignment with the free standing base, engaging the rear edges of the side panels in the tracks and lowering the side panels in the tracks to rest with their lower edges on the free standing base and providing dowels to couple the side panels to the top surface of the free standing base.

7. A method as claimed in claim 1, which further comprises pre-mounting support brackets on the inner sides of the side panels, each bracket having keyhole apertures to receive the heads of screws projecting from the underside of a horizontal element.

8. A method as claimed in claim 7, wherein the screw heads are tapered on their underside and dimensioned to engage the support bracket by friction once the horizontal element has been mounted on its support bracket.

9. A method as claimed in claim 1, which further comprises bracing the upper ends of the side panels by means of a cross piece having projecting screw heads that are engaged in apertured brackets pre-mounted on the side panels.

10. A method as claimed in claim 1, which further comprises mounting resiliently expandable fillets to bridge any gap between the upper edges of the side panels and the room ceiling and/or the side panels and an adjacent wall.

11. A method of constructing a wardrobe or cupboard which comprises:

providing a free standing base having a top surface, two tracks each having an apertured surface, two side panels each having a rear edge having projections, and pins, positioning the free standing base against a wall, securing the two tracks to the wall in vertical disposition and in alignment with opposite respective edges of the free standing base, mounting the two side panels on the tracks by engaging the rear edges of two side panels in the two tracks respectively and engaging the rear projections in the apertures in the tracks, lowering the side panels in the tracks to rest with their lower edges on the free standing base, coupling the side panels to the top surface of the free standing base with the pins, and subsequently securing horizontal elements of the wardrobe or cupboard to the side panels, wherein the engagement of the rear projections of the side panels in the vertical tracks serves to prevent lateral movement of the rear edges of the side panels relative to the wall and to prevent the side panels from separating from the wall but not to support the weight of the side panels.

* * * * *